US007458656B2

(12) United States Patent
Smith

(10) Patent No.: US 7,458,656 B2
(45) Date of Patent: Dec. 2, 2008

(54) MEASURING A PRESSURE DIFFERENCE

(75) Inventor: David E. Smith, Vancouver, WA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 407 days.

(21) Appl. No.: 11/284,162

(22) Filed: Nov. 21, 2005

(65) Prior Publication Data

US 2007/0115307 A1 May 24, 2007

(51) Int. Cl.
*B41J 29/393* (2006.01)

(52) U.S. Cl. ..... 347/19

(58) Field of Classification Search ..... 347/7, 347/19, 85

See application file for complete search history.

(56) References Cited

U.S. PATENT DOCUMENTS 4,094,073 A 6/1978 Parra
5,079,570 A 1/1992 Mohr et al.
5,357,189 A 10/1994 Egami
5,532,582 A 7/1996 Egami
5,731,824 A * 3/1998 Kneezel et al. ..... 347/7
6,109,743 A 8/2000 Takatsugi et al.
6,409,302 B2 6/2002 Altfather et al.
6,412,894 B1 7/2002 Askren et al.
6,545,613 B1 4/2003 Hornback
6,626,513 B2 * 9/2003 Adkins et al. ..... 347/19
6,648,434 B2 * 11/2003 Walker et al. ..... 347/7
6,676,237 B2 1/2004 Kobayashi et al.
6,698,869 B2 3/2004 Vosahlo
6,811,249 B2 11/2004 DeVries et al.
6,874,872 B2 * 4/2005 Lewis et al. ..... 347/85
2004/0114002 A1 6/2004 Kosugi et al.

* cited by examiner

*Primary Examiner*—Anh T. N. Vo

(57) ABSTRACT

Embodiments of measuring a pressure difference are disclosed.

12 Claims, 5 Drawing Sheets

MEASURING A PRESSURE DIFFERENCE

INTRODUCTION

Image forming devices may use colorant to generate printed images by causing ink to be ejected from a printhead. Sensing that a low level of colorant remains for ejection by the printhead can be used to reduce the likelihood of damage to the printhead. However, sensing a level of colorant remaining for ejection to a desired level of accuracy may be difficult and costly.

DETAILED DESCRIPTION

Measuring a level of a colorant in an image forming device's colorant container can assist in reducing the likelihood of colorant becoming depleted without detection. Detecting depletion of the colorant during a print operation can reduce the likelihood that damage occurs to components of an image forming device, for example, to a printhead of an ink-jet printer. Embodiments of the present disclosure utilize a sensor to allow measuring a pressure difference derived from comparison of pressure resulting from colorant remaining in a container, such as in one embodiment a colorant supply cartridge, to pressure in a surrounding environment. Use of electronic circuitry as described in embodiments of the present disclosure assists in determining the level of colorant in the colorant supply cartridge.

Embodiments of the present disclosure include methods, apparatuses, and devices for sensing colorant level in a colorant supply cartridge in an image forming device. Various embodiments described herein use a low cost sensor configuration coupled to circuitry that permits use of the low cost sensor with a less stable supply voltage than may be used without the circuitry. One method embodiment includes measuring a pressure difference between a colorant in a container and a surrounding volume, correlating the pressure difference with an amount of the colorant remaining in the container, and recording a determination of the amount.

Figure 1:
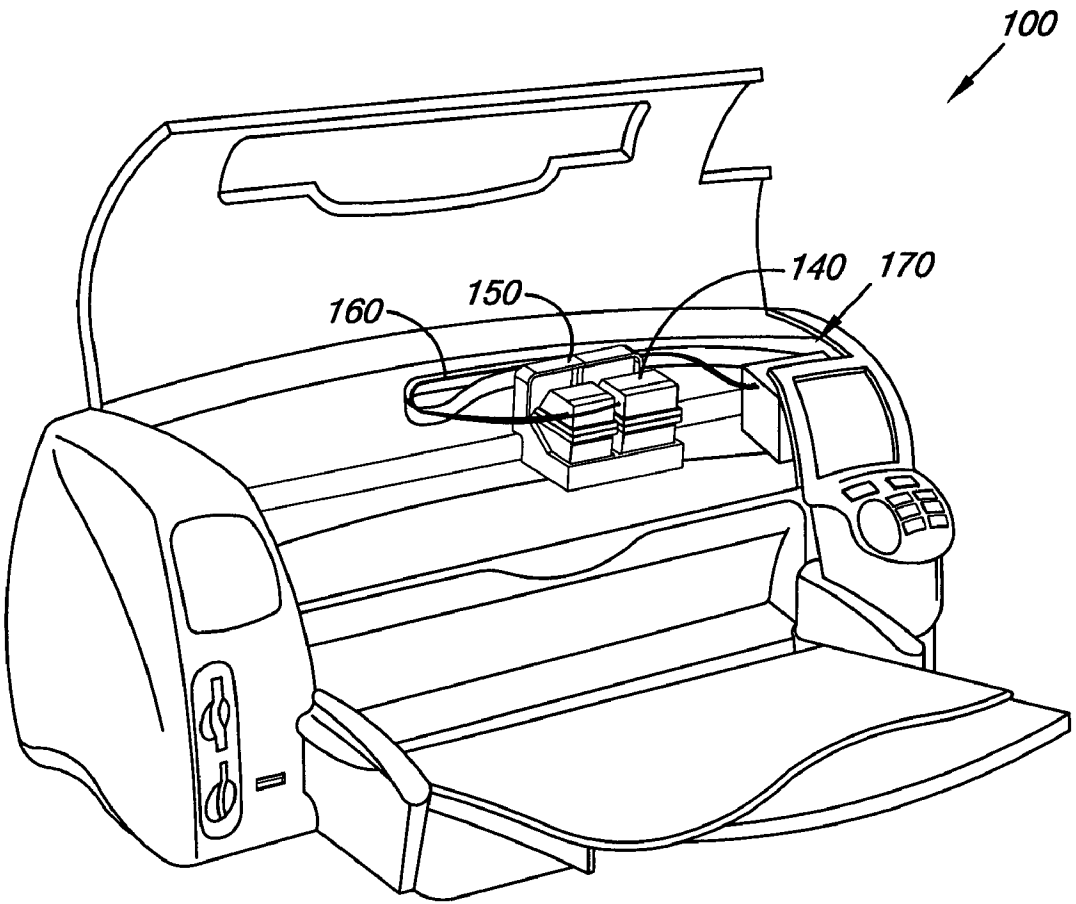
FIG. 1 illustrates an embodiment of an image forming device suitable to implement an embodiment of the present disclosure.

FIG. 1 illustrates an embodiment of an image forming device suitable to implement an embodiment of the present disclosure. FIG. 1 provides a perspective illustration of an embodiment of an image forming device 100 that is operable to implement, or which can include, embodiments of the present disclosure. The embodiment of FIG. 1 illustrates an ink-jet printing device 100 that can be used in an office, home, or commercial printing environment. However, embodiments of the present disclosure can be used in other types of image forming devices and used in other environments.

As illustrated in FIG. 1, an embodiment of the image forming device 100 includes a print cartridge 140 mounted in a movable print carriage 150. The print cartridge 140 contains both an ink reservoir and a printhead for ejecting ink onto print media during a print operation. The movable print carriage 150 can scan the print cartridge 140 across the print media while performing the print operation. The embodiment of FIG. 1 illustrates a flexible conduit 160, such as a flexible tube, which can connect the print cartridge reservoir to an ink supply cartridge via a pump. In the embodiment of FIG. 1, the pump and ink supply cartridge are located off-axis, i.e., they are not located on the movable print carriage 150. The pump and ink supply cartridge can be located in a service bay area, shown generally at 170, as shown in FIG. 1. The ink cartridge reservoir, the ink supply cartridge, and an ink level sensor(s) (not shown), together with interface circuitry and software or, alternatively, an application-specific integrated circuit (ASIC), are part of various embodiments of methods, apparatuses, and devices for determination of the remaining ink level in the ink cartridge reservoir and/or ink supply cartridge. Other examples of image forming devices include laser printers, color copiers, color multi-function-peripherals, and color multi-functional printers. Embodiments are not so limited.

Image forming devices can use various printing techniques. Image forming devices can print on media by using various techniques, such as firing ink through ink jets and/or by using toner and a laser. Various embodiments of image forming devices using various colorants, including ink for ink-jet printers and toner for laser printers, are environments in which embodiments of the present disclosure can be used for sensing colorant level in colorant supply cartridges.

Figure 2:
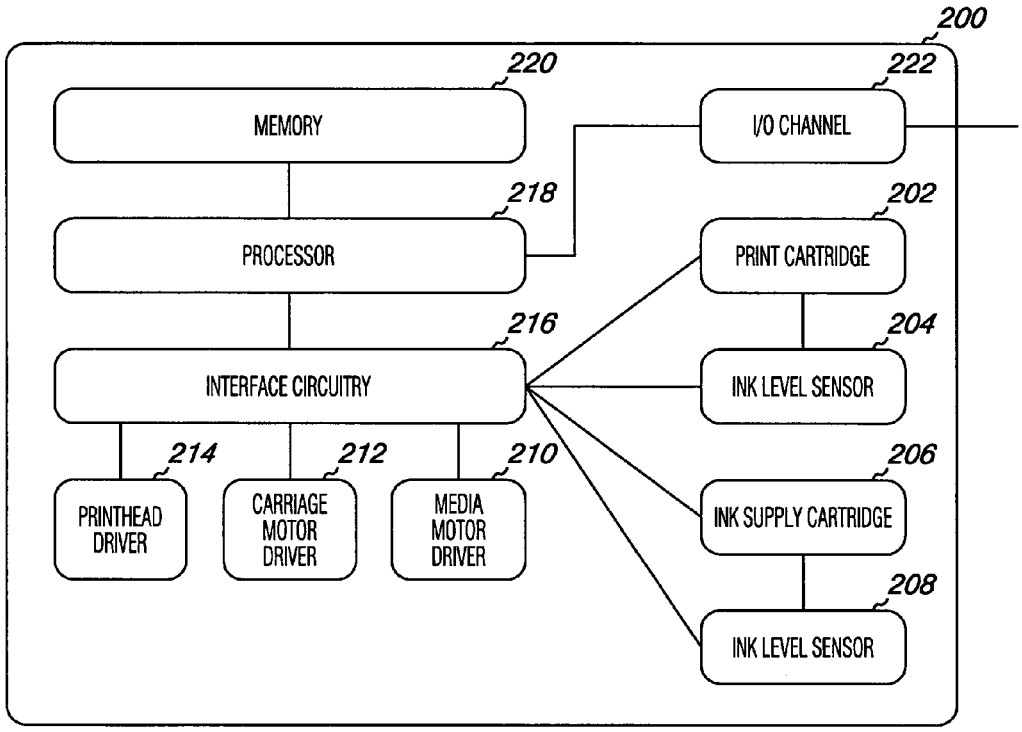
FIG. 2 illustrates a block diagram of an embodiment of the present disclosure.

FIG. 2 illustrates a block diagram of an embodiment of the present disclosure. FIG. 2 illustrates an embodiment of the components associated with an ink-jet printing device 200, such as the image forming device 100 in FIG. 1. As shown in FIG. 2, the components of printing device 200 can include a media marking mechanism, such as print cartridge 202. Electronic components of printing device 200 can include an embodiment of a sensor, such as ink level sensor 204, to assist in determining the ink level in the ink reservoir of print cartridge 202. The components of printing device 200 also can include an embodiment of a container, such as ink supply cartridge 206, that can serve as a source of ink for the ink reservoir of the print cartridge 204. Electronic components of printing device 200 also can include an embodiment of a sensor, such as ink level sensor 208, to assist in determining the ink level in the ink supply cartridge 206. The ink level sensor 204 and the ink level sensor 208 can operate by sensing pressure difference through use of a piezoresistive strain gauge, although embodiments are not so limited.

FIG. 2 further illustrates an embodiment having a media motor driver 210, a carriage motor driver 212, and a printhead driver 214. Interface circuitry 216 is utilized in the printing device 200 to interface between the control logic components and the electromechanical components of the printer, e.g., the printhead of the print cartridge 202, the ink level sensor 204, the ink level sensor 208, and the printhead driver 214. Interface circuitry 216 includes, for example, circuits for moving the printhead and the print media, and for firing individual nozzles. Thus, the media motor driver 210 and the carriage motor driver 212 can be coupled to interface circuitry 216 for moving the print cartridge 202 and print media (not shown). The printhead driver 214 can be coupled to interface circuitry 216 to fire individual nozzles on the printhead of the print cartridge 202.

Moreover, the interface circuitry 216 can be coupled in various embodiments, either directly or indirectly, with the ink reservoir of the print cartridge 202 and the corresponding ink level sensor 204, in addition to the ink supply cartridge 206 and the corresponding ink level sensor 208. The interface circuitry 216 can receive electronic input from ink level sensor 204 and/or ink level sensor 208 to assist in determining ink levels in the print cartridge 202 and ink supply cartridge 206, respectively. For example, the piezoresistive strain gauge (not shown) of ink level sensor 208 can provide the interface circuitry 216 with input reflecting pressure difference between the ink remaining in the ink supply cartridge and its surroundings.

The media motor driver 210, the carriage motor driver 212, and the printhead driver 214 can be utilized to execute computer executable instructions, or routines thereon. In addition, the media motor driver 210, the carriage motor driver 212, and the printhead driver 214 can be independent components or combined on one or more application specific integrated circuits (ASICs). The embodiments of the disclosure, however, are not so limited to these examples.

In the embodiment shown in FIG. 2, the interface circuitry 216 can be coupled to a processor 218. Control logic in the form of executable instructions that can be executed by a controller or processor, such as processor 218, can exist within memory 220. The executable instructions can carry out various control steps and functions for the printing device 200. For example, input from the interface circuitry 216 reflecting sensing of pressure difference resulting from ink remaining in the ink supply cartridge can be used by the processor 218 to correlate the pressure difference with a remaining ink level in the ink supply cartridge 206. In some embodiments, implementing the executable instructions can result in recording a determination of the remaining ink level and acting on a determination of a low remaining ink level in the ink supply cartridge. Memory 220 can include some combination of ROM, dynamic RAM, magnetic media, and optically read media, and/or some type of nonvolatile and writeable memory such as battery-backed memory or flash memory.

The processor 218 is operable on software, e.g., computer executable instructions, received from memory 220 or via an input/output (I/O) channel 222. The embodiments of the present disclosure, however, are not limited to any particular type of memory and are not limited to where within a device or networked system a set of computer instructions reside for use in implementing the various embodiments of the present disclosure. In alternative embodiments, various functions of the interface circuitry 216, the processor 218, and the memory 220 can be supplemented, or replaced, by use of an ASIC having been constructed to perform functions corresponding to those performed by the interface circuitry 216, the processor 218, and the memory 220. For example, an ASIC could determine the remaining ink level in the ink supply cartridge to be low and record this determination by an action resulting in showing the information on display 110 of the image forming device illustrated in FIG. 1. Embodiments of the present disclosure are not so limited.

The processor 218 can be interfaced, or connected, to receive instructions and data from a remote device (e.g., a host computer) through one or more I/O channels or ports 222. I/O channel 222 can include a parallel or serial communications port, and/or a wireless interface for receiving data and information, e.g., print job data, as well as other computer executable instructions, e.g., software routines.

Figure 3:
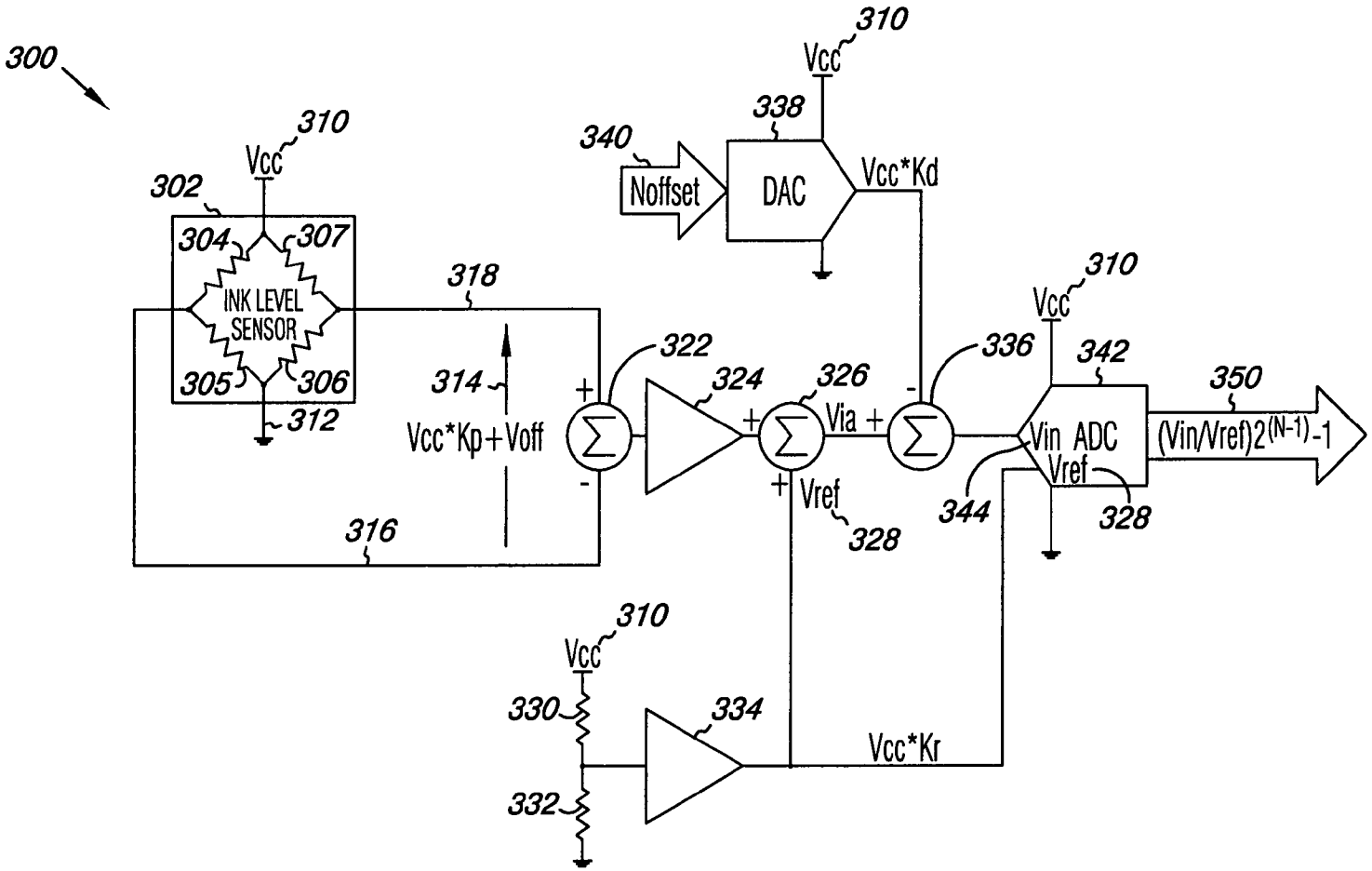
FIG. 3 illustrates an embodiment of an apparatus for sensing colorant level in a colorant supply cartridge in an image forming device.

FIG. 3 illustrates an embodiment of an apparatus for sensing colorant level in a colorant supply cartridge in an image forming device. FIG. 3 illustrates an embodiment of the circuitry of some components associated with printing device 200 in FIG. 2. The apparatus 300 illustrated in FIG. 3 can be used with the image forming device illustrated in FIG. 1. An embodiment of an ink level sensor 302 is shown at the far left of the schematic in FIG. 3. Within this embodiment of the ink level sensor 302 are four resistors 304-307 that comprise a Wheatstone bridge, which collectively functions as a strain gauge. Pressure difference causing deformity of one or more resistors 304-307 in the strain gauge can change the resistance of a side of the bridge being deformed. Deforming one side of the bridge can cause the potential between a supply voltage (Vcc) 310 and a ground 312 to be affected in such a manner as to cause a voltage differential, measured as output voltage, between two sides of the bridge of the ink level sensor 302, shown in FIG. 3 as an embodiment of the present disclosure.

One embodiment of the present disclosure has a resistor on one side of the ink level sensor 302 in contact with, or otherwise affected by, a container for ink, illustrated in FIG. 2 as the print cartridge 202 that contains an ink reservoir (not shown) and/or the ink supply cartridge 206. Varying levels of remaining ink in the ink container can apply corresponding varying levels of pressure to the resistor in contact with, or otherwise affected by, the ink container. As a result, the varying levels of pressure applied to a resistor 304-307 can cause corresponding levels of deformity of the resistor, through which a piezoresistive effect can produce a differential output signal 314. The voltage of the differential output signal 314 can correspond to a degree of deformity of the associated resistor caused by the pressure applied to the resistor, which can result from, and be correlated with, the level of remaining ink in the ink container.

The magnitude of the differential output signal 314 of the ink level sensor 302 illustrated in FIG. 3 is related to the Vcc 310 (i.e., the supply voltage) and a Kp, a gain that is a function of pressure difference applied to the resistor 304-307. Another component of the differential output signal 314 is an offset voltage (Voff). Voff (commonly referred to as DC offset) is inherent voltage output by a transducer, e.g., ink level sensor 302 in the present disclosure, in a resting state with no pressure difference applied to the transducer.

As illustrated in FIG. 3, a lead 316, which can have a potential that results from increased resistance caused by pressure to one or both of resistors 304-305, and a lead 318, which can have a potential that results from unaltered resistance caused by being in an empty surrounding volume, provides the differential output signal 314 of the ink level sensor 302 to a first difference summer 322, with lead 316 coupled to a first input of first difference summer 322 and lead 318 coupled to a second input of the first difference summer 322. In this embodiment, the first difference summer 322 can be coupled to a first gain block 324, which amplifies the output from the first difference summer 322 with a specified amount of voltage gain (A). Output from the first gain block 324 can be transmitted to a second summer 326, which sums the output from the first gain block 324 with a reference voltage 328 (Vref). In this embodiment, the Vref 328 is established by Vcc 310 coupled to a voltage divider, including resistor 330 and resistor 332. The voltage divider can be coupled to a second gain block 334, which may or may not amplify incoming voltage but which can serve as a buffer. As a result, Vref 328 can be a function of Vcc 310 reduced by the effect of resistor 330 and resistor 332, the effect being represented by Kr.

As illustrated in FIG. 3, an output of the second summer 326 (Via) is a function of the previously described differential output signal 314, which includes Vcc 310 as affected by the pressure difference gain Kp to the resistors 304-307 and the Voff, having been amplified by A by the first gain block 324, plus Vref 328.

As illustrated in FIG. 3, the Via signal is transmitted to a third difference summer 336 that also can receive an input from a digital to analog converter 338 (DAC). The DAC 338 includes a power supply input Vcc 310, a ground, and an offset potential input to account for the offset (Voff) described above. The DAC 338 can be adjusted by selecting an input, Noffset 340, whereby the Vcc 310 is adjusted by a factor (Kd) such that the DAC 338 output voltage can be an approximation of Voff as amplified by A by the first gain block 324. The offset voltage processed by the DAC 338 is supplied to the an input of the third difference summer 336 to allow the third difference summer 336 to at least partially remove the contribution of Voff, increased by the gain A applied by the first gain block 324, from the Via input to the third difference summer 336. An analog to digital converter 342 (ADC) can then receive an input voltage 344 (Vin) from the third difference summer 336 containing Vcc 310 as affected by the pressure difference gain Kp, and having been amplified by A by the first gain block 324, plus Vref 328. In addition, the ADC 342 can receive input of Vref 328 from the second gain block 334. As illustrated in the embodiment shown in FIG. 3, the ADC 342 can take the ratio of the input voltage, Vin 344, and the reference voltage, Vref 328, to yield a digital output voltage 350 that can be expressed as $(Vin/Vref)2^{N-1}-1$.

Using the first difference summer 322 can allow a differential output signal 314 provided by the ink level sensor 302 to be converted into a more readily measurable single-ended configuration. The first gain block 324 also can allow the differential output signal 314, which includes Vcc 310 as affected by the pressure difference gain Kp, plus Voff, and which can be small on an absolute scale (e.g., ~+/−50 mV), to be amplified to a more readily measurable level.

Voff can be relatively large (e.g., +/−50 mV) for an ink level sensor 302 in comparison to differential voltage resulting from the piezoresistive effect of an ink container exerting pressure difference gain Kp on a resistor of an ink sensor 302 (e.g., 0-25 mV). Having the DAC 338 provide voltage to the third difference summer 336 that approximates Voff with the gain A supplied by the first gain block 324, which is also a component of the Via input to the third difference summer 336, can allow the contribution of Voff to at least partially be removed by the third difference summer 336 from the Vin 344 provided to the ADC 342. By employing this circuit the ability of Voff to exert an overwhelming influence on the differential output signal 314 can be reduced. As a result, a piezoresistive sensor can be used to detect an amount of ink remaining in the ink container. That is, although possibly smaller than Voff, a pressure difference gain Kp to at least one resistor 304-307 of the ink level sensor 302 can still be detected.

Because Vcc 310 is used in deriving both the Vin 344 and Vref 328 voltages input to the ADC 342, a ratiometric technique allows Vcc 310 to be canceled out, or at least have its effect substantially removed out of the digital output voltage 350 of the ADC 342. The digital output voltage 350 can be represented as $(Vin/Vref)2^{N-1}-1$. This equation can be mathematically converted to $(KpA/Kr+1)2^{N-1}-1$. Consequently, variances in the digital output voltage 350 can be considered to result from variation in the pressure difference gain Kp and the parameters A and Kr, along with variance in Kd, i.e., a factor influencing the offset voltage approximation supplied by DAC 338. As a result, the digital output voltage 350 can be independent, or at least partially independent, of Vcc 310. The preceding embodiments are offered by way of example and embodiments are not so limited.

Between the ink level sensor 302 and the digital output voltage 350, the circuitry can be described as interface circuitry because it receives the differential output signal 314 from the sensor 302 and processes the differential output signal into digital output voltage 350 suitable for input into the processor (218 in FIG. 2). A processor can execute instructions to compare the digital output voltage 350 to a table in a memory (220 in FIG. 2) to correlate the pressure difference with a remaining ink level in the ink supply cartridge and record a determination of the remaining ink level in the ink supply cartridge. For example, an indication of the low remaining ink in the ink supply cartridge can be displayed in a location accessible to a user of a print device. The processor can further execute instructions storable in the memory to act upon a determination of a low remaining ink level in the ink supply cartridge. For example, the printing device can delay progress of a print operation to reduce the likelihood of damage to a printhead until a replacement ink supply cartridge has been appropriately provided to the printing device. The embodiments, however, are not so limited to this example action.

Figure 4:
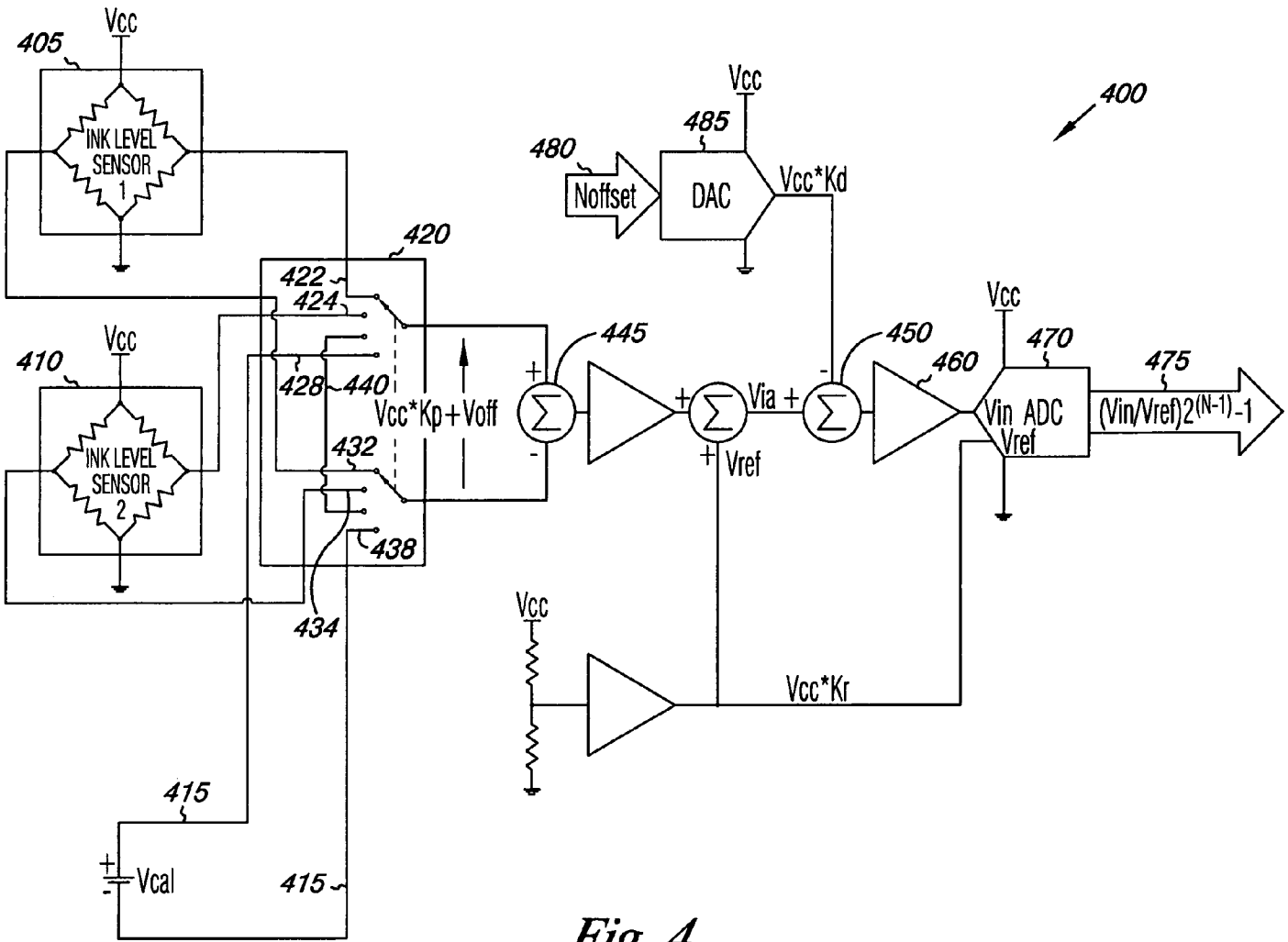
FIG. 4 illustrates another embodiment of an apparatus for sensing colorant level in a colorant supply cartridge in an image forming device.

FIG. 4 illustrates another embodiment of an apparatus for sensing colorant level in a colorant supply cartridge in an image forming device. FIG. 4 illustrates an embodiment of additional circuitry for the apparatus described above with regard to FIG. 3. The apparatus 400 illustrated in FIG. 4 can be used with the image forming device illustrated in FIG. 1. The central portion of the schematic representing the circuitry of apparatus 400 is unchanged in FIG. 4 compared to FIG. 3. However, the far left side now includes a first ink level sensor 405 and a second ink level sensor 410, a calibration voltage input channel 415, and a multiplexor 420. Leads from the first ink level sensor 405, the second ink level sensor 410, and the calibration voltage input channel 415 converge in a multiplexer 420. The multiplexer 420 can allow switching from a lead 422, that can be coupled to a second input of first difference summer 445, and a lead 432, that can be coupled to a first input of the first difference summer 445, coming from the first ink level sensor 405 to a lead 424, that can be coupled to the second input of first difference summer 445, and a lead 434, that can be coupled to the first input of the first difference summer 445, coming from the second ink level sensor 410. The two ink level sensors just described are intended to illustrate that an unlimited plurality of ink level sensors in a printing device having a corresponding number of leads connected to the multiplexer 420 may be implemented in embodiments of the present disclosure.

In FIG. 4, input voltage to multiplexer 420 can come from the first ink level sensor 405, the second ink level sensor 410, or any additional ink level sensors (not shown). The multiplexer 420 can switch from the ink level sensor leads to a lead 428, that can be coupled to the second input of first difference summer 445, and a lead 438, that can be coupled to the first input of first difference summer 445, coming from the calibration voltage input channels 415. The input voltage also can come from the calibration voltage input channels 415. The multiplexer 420 can preclude connection to a source of input voltage by switching to the closed circuit 440 to remove input from the ink level sensors and/or the calibration voltage input channel. Embodiments of the sources of input voltage that can be relayed by the multiplexer 420 are not so limited. The multiplexer 420 transmits an output voltage to the first difference summer 445 (322 in FIG. 3) of the interface circuitry previously described with reference to FIG. 3.

Appropriate calibration techniques can reduce errors caused by variance from the specification values for components of the apparatus. Variance from the specifications includes variances of those components illustrated in FIG. 3, including variances of resistors, e.g., resistors 330 and 332 that determine parameter Kr, and gain blocks, e.g., the first gain block 324 that provides gain A. Using the ratiometric technique described above allows for use of a less stable supply voltage Vcc 310, than would otherwise be used to achieve a desirable level of accuracy, for the apparatus in order to achieve a digital output voltage 350 that is indicative of a particular ink level in the ink container being measured by the corresponding ink level sensor 302.

As illustrated in FIG. 4, the calibration voltage input channel 415 can provide input voltage to the multiplexer 420. By providing a predetermined input voltage to be processed by the interface circuitry, the calibration voltage input channel 415 can enable auto-calibrating that can reduce errors in determination of the digital output voltage 475 caused by variance from specification values for components in the interface circuitry of the apparatus 400. When selected by the multiplexer 420, the closed circuit 440 can assist auto-calibration by providing a reference level of negligible input voltage provided for processing by the interface circuitry, which can enable determination of the Voff supplied by each ink level sensor. Determination of Voff can assist in selecting a value for Noffset 480 for input to the DAC 485, which outputs a proportional approximation of Voff to the third difference summer 450. The third difference summer 450 uses the proportional approximation of Voff provided by the DAC 485 to reduce the effect of Voff output by an ink level sensor, e.g., the first ink level sensor 405, that is amplified by upstream elements of the interface circuitry. The effect on the digital output voltage 475 can be reduced by auto-calibration to achieve greater accuracy in determining Voff.

Toward the right side of the schematic of apparatus 400 in FIG. 4, a third gain block 460 is shown inserted between the third difference summer 450 (336 in FIG. 3) and the ADC 470 (342 in FIG. 3). The third gain block 460 applies a voltage gain B to the output voltage of the third difference summer 450 before the output voltage becomes input for the ADC 470. The voltage B gain applied by the third gain block 460 to the output voltage of the third difference summer 450 increases the output voltage after the output voltage has been reduced by at least partial cancellation of the contribution of amplified Voff. The voltage gain B supplied by the third gain block 460 can amplify the output voltage from the third difference summer 450 to a more readily measurable level prior to input to the ADC 470. The amplified signal can then be supplied to the ADC 470 for conversion into the digital output voltage 475 supplied to the processor for correlation with a corresponding ink level in an ink reservoir or ink supply cartridge.

Having a plurality of ink level sensors, as exemplified in FIG. 4, allows ink level to be measured in a plurality of ink containers. For example, if the apparatus 400 in FIG. 4 has seven print cartridges, the differential voltage signal from each of the seven print cartridges can be independently sensed by seven ink level sensors, one associated with each of the seven ink reservoirs. After processing by the interface circuitry, the digital output voltages from each of the seven ink level sensors can be correlated with a remaining ink level in each of the seven ink reservoirs of the seven print cartridges. As the same has been described in connection with FIG. 3, recording the remaining ink level in each of the print cartridges allows acting upon a determination of a low remaining ink level in the ink reservoir having the lowest ink level prior to possible damage to a printhead in the print cartridge caused by depletion of the remaining ink in the ink reservoir of that cartridge. In addition, having an ink level sensor in each of a plurality of ink supply cartridges can assist in measuring the ink level in each, thereby contributing to a reduction in the likelihood of undetected ink depletion in each of the ink supply cartridges.

In some embodiments, a means for counting of ink drops can be used to cross-check a determination of the remaining ink level in the ink supply cartridge accomplished as described in the present disclosure. Various methodologies for counting ink drops may be employed to assist in reducing the likelihood of undetected ink depletion in the ink supply cartridge. For example, an ink-jet printing device may begin by counting drops until a predetermined amount of ink has been ejected from the ink supply cartridge and then switch to utilizing the sensors described in the present disclosure. The ink-jet printing device may subsequently switch back to counting ink drops when the ink level has been determined to be low enough so as to make difficult further determination of a pressure difference. The embodiments, however, are not so limited to this example.

Colorant level sensors include the previously described ink level sensors that can be used in ink-jet printing devices. Colorant level sensors also include toner level sensors that can be used in laser printers to assist in preventing depletion of toner in the toner cartridge. Embodiments of colorant level sensors are not so limited. Colorant supply cartridges include the previously described ink containers, ink reservoirs, and ink supply cartridges. In addition, colorant supply cartridges include toner cartridges. Embodiments of colorant supply cartridges are not so limited.

Figure 5:
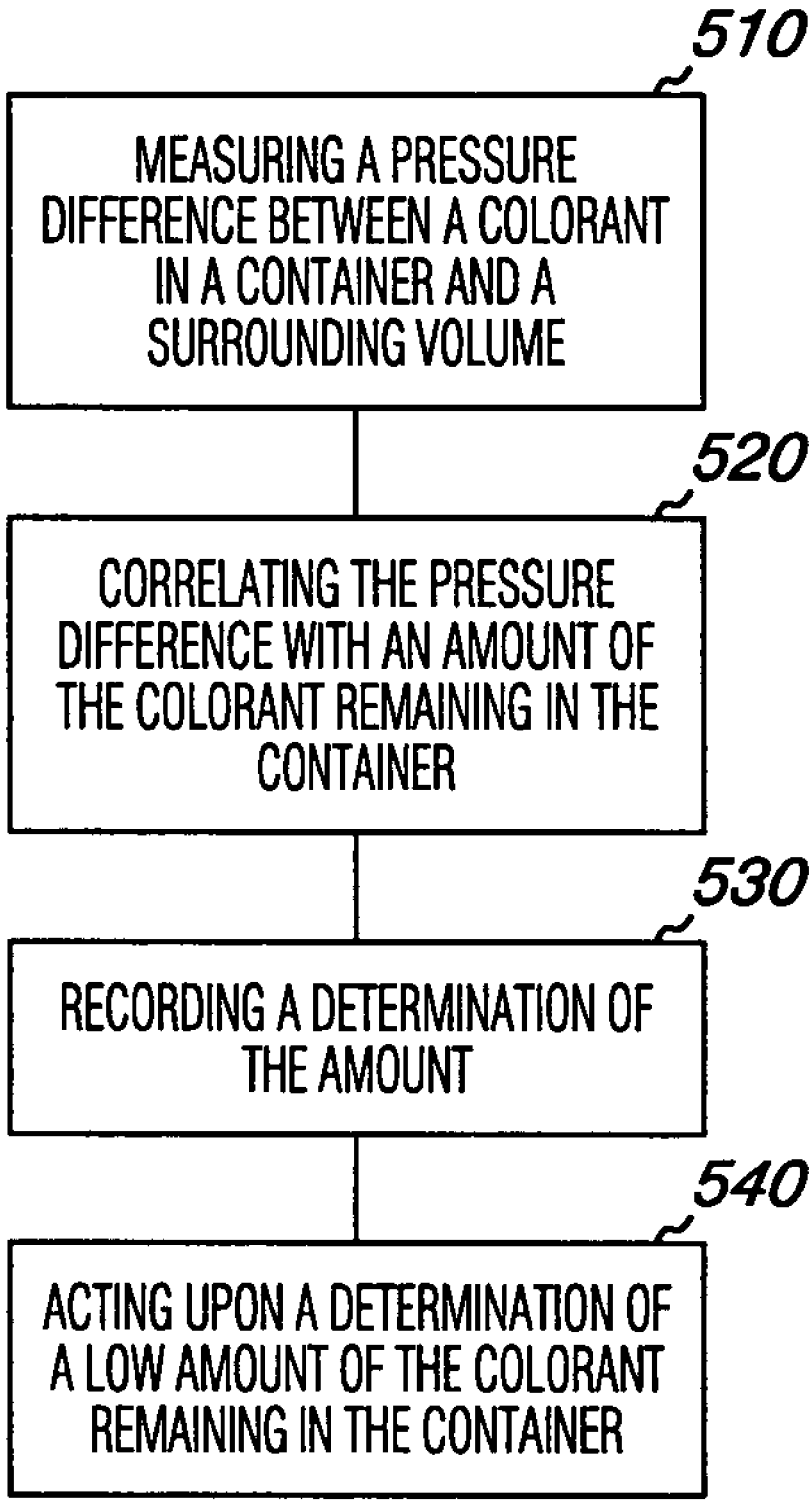
FIG. 5 is a block diagram illustrating an embodiment of a method for sensing colorant level in a colorant supply cartridge, according to embodiments of the present disclosure.

FIG. 5 is a block diagram illustrating an embodiment of a method for sensing colorant level in a colorant supply cartridge, according to embodiments of the present disclosure. In block 510, the method includes measuring a pressure difference between a colorant in a container and a surrounding volume, as described in connection with FIG. 3. That is, the pressure difference can be sensed because colorant remaining in the container, such as a colorant supply cartridge, applies a pressure difference to a resistor in a strain gauge serving as a colorant level sensor compared to pressure exerted in the space surrounding the sensor. As described above, application of pressure can deform the resistor, thereby altering the resistance of the resistor due to the piezoresistive effect. Altering the resistance of one side of the strain gauge can result-in a voltage that differs between the two sides of the strain gauge, the magnitude of which can be measured as a differential output signal. The magnitude of the differential output signal coming from the colorant level sensor can correspond to the magnitude of pressure being applied to deform the resistor in the colorant level sensor, which, in turn, can correspond to the level of colorant in the colorant supply cartridge. Levels of colorant can be sensed in a plurality of colorant supply cartridges and attributed to the proper colorant supply cartridge through use of a multiplexing circuit.

In block 520, the method includes correlating the pressure difference with an amount of the colorant remaining in the container, such as the colorant supply cartridge. The digital output voltage resulting from the interface circuitry processing the differential output signal, as described in connection with FIGS. 3 and 4, can be sent from the ADC to a processor, executing instructions stored in a memory, to correlate the magnitude of the digital output voltage with an amount of colorant in the colorant supply cartridge. Errors in correlating the digital output voltage with a particular colorant amount can be reduced through use of auto-calibration techniques that use a calibration voltage input channel and a short circuit selectable by the multiplexer. Auto-calibration can reduce the effect on the differential output signal voltage coming from the colorant level sensors that can be caused by variance from specified values for components of the interface circuitry. Auto-calibration also can allow a determination of the offset voltage supplied by the colorant level sensor to assist in reducing the contribution of the offset voltage to the digital output voltage. Auto-calibration thereby assists in more accurately correlating a digital output voltage with a remaining colorant amount.

In block 530, the method includes recording a determination of the amount of the colorant remaining in the colorant supply cartridge. To assist in making the determination of remaining colorant amount(s) useful, the amount of colorant remaining in each colorant supply cartridge can be recorded. Recording the amount of colorant remaining for each colorant supply cartridge allows the record to be accessed at that time or subsequently. Accessing the amount of colorant remaining in each colorant supply cartridge allows a comparison of the amounts of colorant remaining among a plurality of colorant supply cartridges. The amount of colorant remaining in each colorant supply cartridge can be made accessible to the user by being shown on a display on the image forming device or otherwise, e.g., on the screen of a networked monitor. Embodiments are not so limited.

In block 540, the method can include acting upon a determination of a low amount of the colorant remaining in the container, such as the colorant supply cartridge. In one embodiment of the present disclosure, a low amount of colorant remaining in one or more of the colorant supply cartridges can cause the image forming device, or a separate device controlling the image forming device, to perform an action. For example, the image forming device can delay execution or continuation of a current print command until the colorant supply cartridge has been replaced with one containing sufficient colorant to allow continuation without risk of damage to components of the image forming device. Alternatively, execution or continuation of the current print command can be delayed until the user inputs a command to cancel the delay. Embodiments are not so limited.

Although the methods in blocks 510, 520, 530, and 540 of FIG. 5 are described as using a processor and memory, i.e., software, together with interface circuitry, an ASIC can be included to perform some or all of the functions described for the interface circuitry working together with a processor and memory.

The embodiments provided herein describe circuitry for measuring a pressure difference resulting from colorant remaining in the colorant supply cartridge. The circuit embodiments described in the present disclosure can be used to produce a digital voltage that can be operated on by software, hardware, application modules, and the like to perform the operations described herein. Such circuitry, software, hardware, application modules, and the like can be resident on the apparatuses and devices shown herein or otherwise. Software and memory suitable for carrying out embodiments of the present disclosure can be resident in one or more devices or locations. Processing modules can include separate modules connected together or can include several modules on an ASIC.

Although specific embodiments have been illustrated and described herein, those of ordinary skill in the art will appreciate that an arrangement calculated to achieve the same results can be substituted for the specific embodiments shown. This disclosure is intended to cover all adaptations or variations of various embodiments of the present disclosure. It is to be understood that the above description has been made in an illustrative fashion, and not a restrictive one. Combination of the above embodiments, and other embodiments not specifically described herein will be apparent to those of skill in the art upon reviewing the above description. The scope of the various embodiments of the present disclosure includes other applications in which the above structures and methods are used. Therefore, the scope of various embodiments of the present disclosure should be determined with reference to the appended claims, along with the full range of equivalents to which such claims are entitled.

In the foregoing Detailed Description, various features are grouped together in a single embodiment for the purpose of streamlining the disclosure. This method of disclosure is not to be interpreted as reflecting an intention that the disclosed embodiments of the present disclosure have to use more features than are expressly recited in each claim. Rather, as the following claims reflect, inventive subject matter lies in less than all features of a single disclosed embodiment. Thus, the following claims are hereby incorporated into the Detailed Description, with each claim standing on its own as a separate embodiment.

What is claimed:

1. A method comprising:

measuring a pressure difference between a colorant in a container and a surrounding volume, wherein measuring generates a differential output signal from an input voltage, the differential output signal having a magnitude corresponding to the measured pressure difference and including an offset voltage;

producing an amplified voltage from the differential voltage signal, the offset voltage being amplified in the amplified voltage;

producing a first summed voltage output from the amplified voltage and a reference voltage;

producing an approximation of the amplified offset voltage;

producing a second summed voltage by reducing the first summed voltage by an approximation of the amplified offset voltage;

producing a digital output voltage from the second summed voltage and the reference voltage, the digital output voltage;

utilizing the digital output voltage to correlate the pressure difference with an amount of the colorant remaining in the container; and recording the amount.

2. The method of claim 1, including acting upon a determination of a low amount of the colorant remaining in the container.

3. The method of claim 2, wherein acting upon the determination of a low amount of the colorant remaining in the container includes delaying a print operation to allow more colorant to be provided before resuming the print operation and allowing the user to cancel a delay.

4. The method of claim 1, including containing the colorant in a colorant supply cartridge.

5. The method of claim 1, wherein measuring the pressure difference includes using a piezoresistive strain gauge as a sensor.

6. The method of claim 1, wherein measuring the pressure difference includes auto-calibrating that can allow a determination of the offset voltage produced by a colorant level sensor.

7. The method of claim 6, wherein the auto-calibrating includes reducing an effect on the differential output signal voltage caused by a variance from a specified value for a circuitry component.

8. The method of claim 1, wherein recording the amount includes displaying the amount to a user.

9. A computer readable medium having instructions for causing a device to perform a method, comprising:

measuring a pressure difference between a colorant in a container and a surrounding volume, wherein measuring generates a differential output signal from an input voltage, the differential output signal having a magnitude corresponding to the measured pressure difference and including an offset voltage;

producing an amplified voltage from the differential voltage signal, the offset voltage being amplified in the amplified voltage;

producing a first summed voltage output from the amplified voltage and a reference voltage;

producing an approximation of the amplified offset voltage;

producing a second summed voltage by reducing the first summed voltage by an approximation of the amplified offset voltage;

producing a digital output voltage from the second summed voltage and the reference voltage, the digital output voltage;

utilizing the digital output voltage to correlate the pressure difference with an amount of the colorant remaining in the container; and recording the amount.

10. The medium of claim 9, wherein the method includes acting upon a determination of a low amount of the colorant remaining in the container to delay a print operation in order to allow more colorant to be provided before resuming the print operation.

11. The medium of claim 9, wherein measuring the pressure difference includes auto-calibrating to allow a determination of the offset voltage produced by a colorant level sensor.

12. The medium of claim 11, wherein the auto-calibrating includes reducing an effect on the differential output signal voltage caused by a variance from a specified value associated with a circuitry component.

* * * * *